US011107608B2

(12) United States Patent
Kolehmainen et al.

(10) Patent No.: US 11,107,608 B2
(45) Date of Patent: Aug. 31, 2021

(54) CORONA PROTECTION DEVICE

(71) Applicant: Hubbell Incorporated, Shelton, CT (US)

(72) Inventors: Sarah Kelley Kolehmainen, Greenville, SC (US); Robert Allen Bernstorf, Rittman, OH (US); Jeffrey Miller Butler, Martinez, GA (US); Peter James Swales, Aiken, SC (US); Michael Joseph Lee, Aiken, SC (US); John Schonewolf, Martinez, GA (US)

(73) Assignee: Hubbell Incorporated, Shelton, CT (US)

( * ) Notice: Subject to any disclaimer, the term of this patent is extended or adjusted under 35 U.S.C. 154(b) by 140 days.

(21) Appl. No.: 16/145,698

(22) Filed: Sep. 28, 2018

(65) Prior Publication Data

US 2019/0103205 A1 Apr. 4, 2019

Related U.S. Application Data

(60) Provisional application No. 62/565,739, filed on Sep. 29, 2017.

(51) Int. Cl.
*H01B 17/44* (2006.01)

(52) U.S. Cl.
CPC ..... *H01B 17/44* (2013.01)

(58) Field of Classification Search
CPC ..... H01B 17/44; H01B 17/42; H01B 17/46; H02G 15/18; H02G 15/184; H02G 15/188; H01T 19/02
USPC ..... 174/140 CR, 140 R, 139, 137 R, 138 R, 174/127, 140 H, 144
See application file for complete search history.

(56) References Cited

U.S. PATENT DOCUMENTS

| | | | |
|---|---|---|---|
| 2,835,725 | A | 5/1958 | Nicholas et al. |
| 3,192,312 | A | 6/1965 | Sauer |
| 3,437,741 | A | 4/1969 | Beck |
| 3,702,372 | A | 11/1972 | Troccoli |
| 3,735,019 | A | 5/1973 | Hess et al. |
| 3,828,116 | A | 8/1974 | Lonow |
| 3,836,705 | A | 9/1974 | Rosenblatt |
| 3,930,113 | A | 12/1975 | Johansen et al. |
| 3,941,918 | A | 3/1976 | Nigol et al. |
| 4,103,103 | A | 7/1978 | Hizikata |
| 4,198,538 | A | 4/1980 | Lusk |
| 4,343,966 | A | 8/1982 | Pargamin |
| 4,355,200 | A | 10/1982 | Wheeler et al. |
| 4,443,659 | A | 4/1984 | Tatem |

(Continued)

FOREIGN PATENT DOCUMENTS

WO WO 2012/003074 1/2012

OTHER PUBLICATIONS

PCT International Search Report and Written Opinion for corresponding PCT Application No. PCT/US2018/053496, dated Dec. 11, 2018, 9 pages.

*Primary Examiner* — Angel R Estrada
(74) *Attorney, Agent, or Firm* — Michael Best & Friedrich LLP

(57) ABSTRACT

A corona protection device can include a body. The corona protection device can include an arm. The arm can extend from the body. The corona protection device can include a retention member. The retention member can define a cavity adapted to engage a portion of an end fitting of an insulator assembly.

20 Claims, 29 Drawing Sheets

(56) References Cited

U.S. PATENT DOCUMENTS

| | | | | |
|---|---|---|---|---|
| 4,724,284 | A | 2/1988 | Wheeler | |
| 5,159,158 | A | 10/1992 | Sakich et al. | |
| 5,216,570 | A | 6/1993 | Yorozuya et al. | |
| 5,336,852 | A | 8/1994 | Goch et al. | |
| 5,552,566 | A | 9/1996 | Lin et al. | |
| 5,705,775 | A | 1/1998 | Ishihara et al. | |
| 5,796,048 | A | 8/1998 | Suzuki et al. | |
| 5,903,427 | A | 5/1999 | Roby | |
| 6,075,209 | A | 6/2000 | Luzzi | |
| 6,265,669 | B1 * | 7/2001 | Richards | H01B 17/42<br>174/140 C |
| 6,388,197 | B1 | 5/2002 | Zhao et al. | |
| 6,455,782 | B1 * | 9/2002 | Lin | H01B 17/44<br>174/140 CR |
| 7,709,743 | B2 | 5/2010 | Bernstorf et al. | |
| 8,653,376 | B2 * | 2/2014 | Birrer | H01B 17/44<br>174/140 CR |
| D771,567 | S | 11/2016 | Flohe et al. | |

* cited by examiner

CORONA PROTECTION DEVICE

PRIORITY CLAIM

The present application is based on and claims priority to U.S. Provisional Application No. 62/565,739, titled "A Corona Protection Device," having a filing date of Sep. 29, 2017, which is incorporated by reference herein.

FIELD

The present disclosure relates generally to corona protection devices.

BACKGROUND

An insulator assembly can be used in power transmission and distribution systems td provide mechanical support for conductors. In addition, the insulator assembly can provide electrical insulation between the high voltage conductors and grounded structures, such as a transmission tower. A corona protection device can be used to eliminate corona discharge from the insulator assembly. Elimination of the corona discharge can protect the insulator assembly against deterioration caused by electric stress. However, orientation of the corona protection device relative to the insulator assembly can impact the ability of the corona protection device to eliminate the corona discharge.

BRIEF DESCRIPTION

Aspects and advantages of embodiments of the present disclosure will be set forth in part in the following description, or may be learned from the description, or may be learned through practice of the embodiments.

In one aspect, the present disclosure is directed to a corona protection device configured for use with an insulator assembly. The corona protection device can include a body. The corona protection device can also include an arm extending from the body. In addition, the corona protection device can include a retention member extending from the arm. The retention member can define a cavity adapted to engage a portion of the insulator assembly.

In another aspect, the present disclosure is directed to an insulator assembly. The insulator assembly includes a core and a plurality of weathersheds surrounding the core. The insulator assembly further includes an end fitting secured to the core. In addition, the insulator assembly includes a corona protection device coupled to the end fitting. The corona protection device includes a body defining at least a partial ring. The corona protection device includes an arm extending from the body. The corona protection device includes a retention member extending from the arm. The retention member defines a cavity adapted to engage a portion of the insulator assembly.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
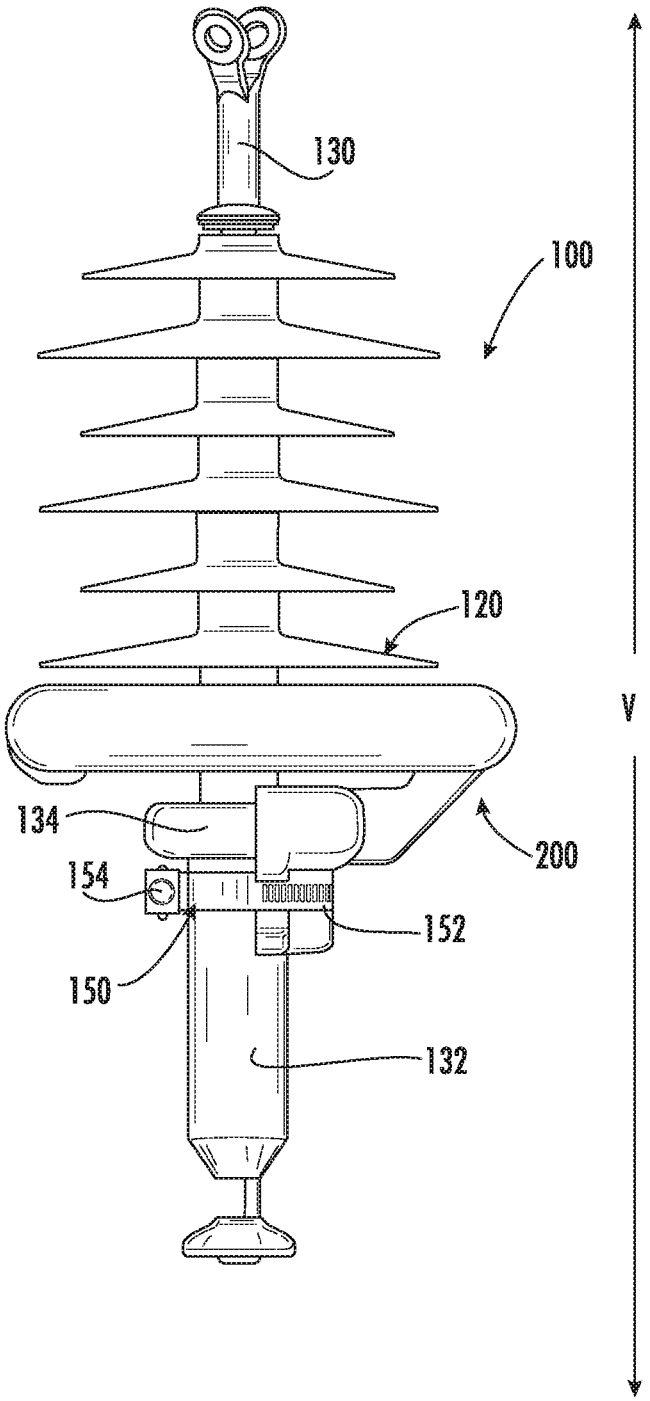
FIG. 1 provides a side view of an insulator assembly according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example embodiments of the present disclosure are directed to a corona protection device for use with an insulator assembly. The corona protection device can include a body. The corona protection device can also include an arm extending from the body. Still further, the corona protection device can include a retention member extending from the arm. More specifically, the retention member can extend from an end of the arm that is distal relative to the body. The retention member can also be spaced apart from the body along a vertical direction. In addition, the retention member can define a cavity adapted to engage a portion of an end fitting of the insulator assembly, such as a corona suppression ring.

In some implementations, an exterior surface of the retention member can define one or more notches. The one or more notches can receive a fastener, such as a band clamp. The fastener can be installed to secure the corona protection device to the insulator assembly. In addition, the one or more notches can be positioned between the cavity and a top portion of the retention member along a vertical direction.

In some implementations, the shape of the retention member can correspond to the shape of a portion of the insulator assembly. As such, the shape of the retention member can provide a visual indicator to couple the retention member to the portion of the insulator assembly having a shape that corresponds to the shape of the retention member. In this way, the shape of the retention member can ensure the orientation of the corona protection device is proper (e.g., not upside down).

The corona protection device according to example embodiments of the present disclosure can provide a number of technical effects and benefits. For instance, the shape of the retention member as well as the arrangement of both the retention member and the arm relative to the body of the corona protection device can ensure the corona protection is installed correctly. In addition, the arrangement of the arm and the retention member eliminates the need for a crossbar that attaches to the body at two discrete locations.

Another example aspect of the present disclosure is directed to an insulator assembly. The insulator assembly can include a core. The insulator assembly can also include a plurality of weathersheds that surround the core. The insulator assembly can also include an end fitting secured to the core. The insulator assembly can include a corona protection device coupled to the end fitting. The corona protection device can include a body. The corona protection device can also include an arm extending from the body (e.g., a corona ring). More specifically, the retention member can extend from an end of the arm that is distal relative to the body. Still further, the corona protection device can include a retention member extending from the arm. The retention member can be spaced apart from the body along a vertical direction. The retention member can also define a cavity adapted to engage a portion of an end fitting of the insulator assembly, such as a corona suppression ring.

In some implementations, an exterior surface of the retention member can define one or more notches. The one or more notches can receive a fastener, such as a band clamp. The fastener can be installed to secure the corona protection device to the insulator assembly. In some implementations, the one or more notches can be positioned between the cavity and a top portion of the retention member along a vertical direction. Alternatively or additionally, the body of the corona protection device can be positioned between the retention member and one of the weathersheds along a vertical direction.

Yet another example aspect of the present disclosure is directed to a method for securing a corona protection device to an end fitting of an insulator assembly. The method can include positioning a retention member of the corona protection device so that a portion of the end fitting is positioned within a cavity defined by the retention member. In some implementations, the portion of the end fitting can comprise a corona suppression ring. The method can also include installing a fastener assembly around both the retention member and the end fitting. In some implementations, the fastener assembly can comprise a band clamp. The method can also include tightening the fastener assembly to secure the corona protection device to the end fitting.

Still another example aspect of the present disclosure is directed to a corona protection device. The corona protection device can include a body defining at least a partial ring. The corona protection device can also include an arm extending from the body. Still further, the corona protection device can include a retention member extending from the arm. The retention member can define one or more notches. More specifically, an exterior surface of the retention member can define the one or more notches.

In some implementations, the one or more notches are configured to receive a fastener assembly when the corona protection device is secured to an insulator assembly. The fastener assembly can be a band clamp. Alternatively or additionally, the retention member can define a cavity. The cavity can be adapted to engage a portion of an end fitting of the insulator assembly, such as the corona suppression ring. The cavity can be positioned between the one or more notches and a top portion of the retention member along a vertical direction.

Figure 2:
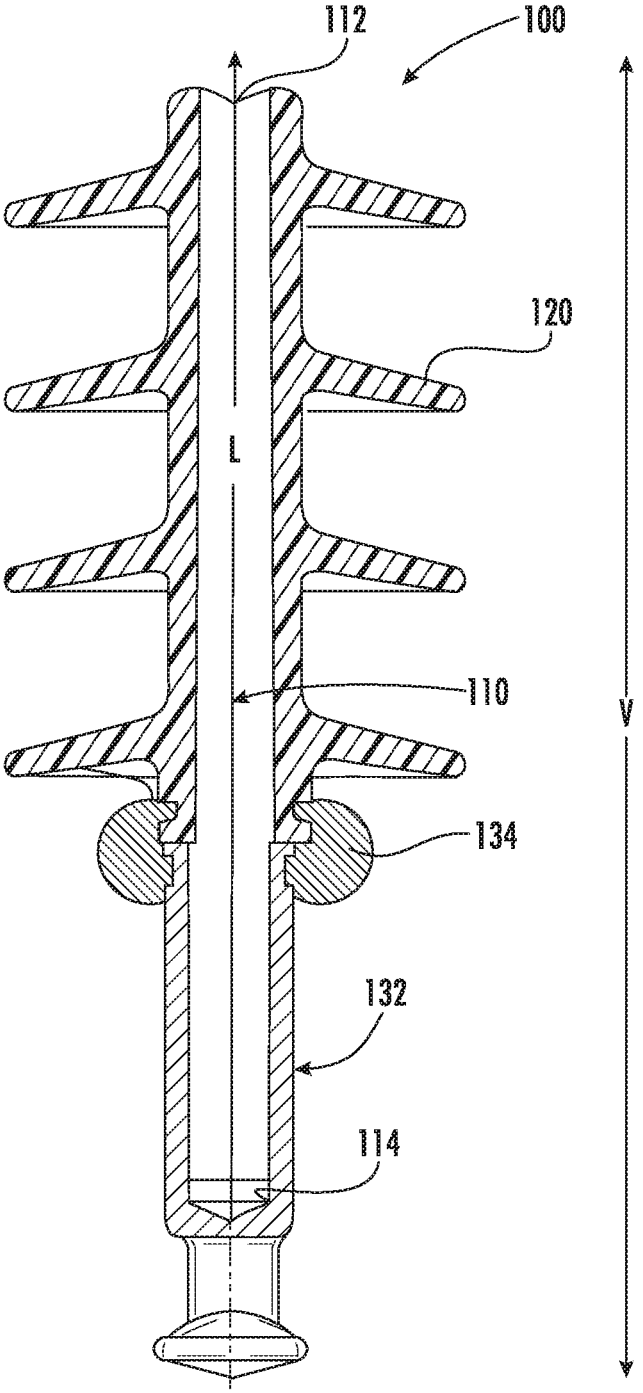
FIG. 2 provides a cross-sectional view of a core of an insulator assembly according to example embodiments of the present disclosure.
Figure 3:
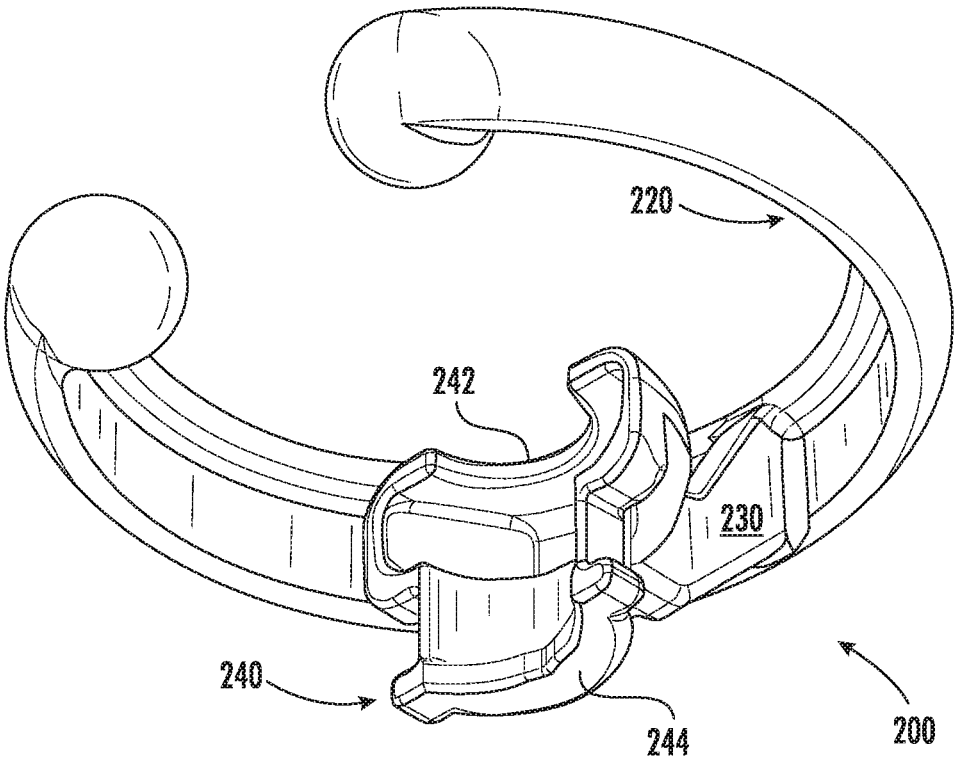
FIG. 3 provides a corona protection device according to example embodiments of the present disclosure.
Figure 4:
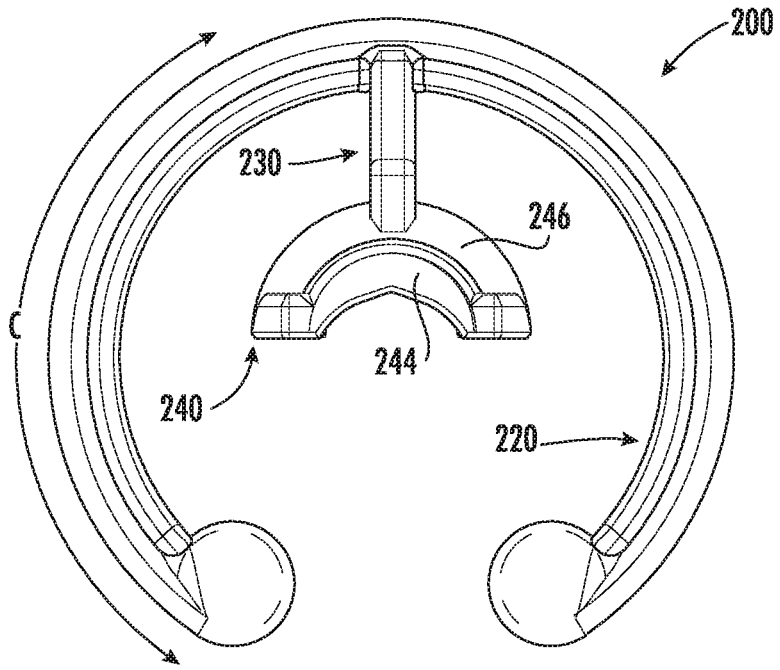
FIG. 4 provides a bottom view of a corona protection device according to example embodiments of the present disclosure.

Referring now to the FIGS., FIGS. 1 and 2 depict an insulator assembly 100 according to example embodiments of the present disclosure. As shown, the insulator assembly 100 can include a core 110 extending between a first end 112 and a second end 114 along a vertical direction V. In some implementations, the core 110 can include resin-bonded glass fibers. It should be appreciated, however, that the core 110 can be comprised of any suitable material.

As shown, the insulator assembly 100 can include a plurality of weathersheds 120 surrounding the core 110 and spaced apart from one another along a length L of the core 110. It should be appreciated that the plurality of weathersheds 120 can be comprised of any suitable material. For instance, the plurality of weathersheds 120 can be comprised of a composite material, such as silicone rubber.

The insulator assembly 100 can include a pair of end fittings 130, 132 secured to the core 110. When the end fittings 130, 132 are secured to the core 110, the end fittings 130, 132 will remain in place absent application of an external force. Each end fitting 130, 132 can fit over one of the ends 112, 114 of the core 110. In this way, the end fittings 130, 132 can be used to cap respective ends 112, 114 of the core 110. It should be appreciated that the end fittings 130, 132 can include any suitable type of end fitting. For instance, one of the end fittings 132 can be a ball-end fitting.

In some implementations, one of the end fittings 132 can include a corona suppression ring (CSR) 134. For example, the CSR 134 can be integral with the end fitting 132. It should be appreciated that both the CSR 134 and the pair of end fittings 130, 132 can be comprised of any suitable material. For example, both the end fittings 130, 132 and the CSR 134 can be comprised of aluminum.

Figure 5:
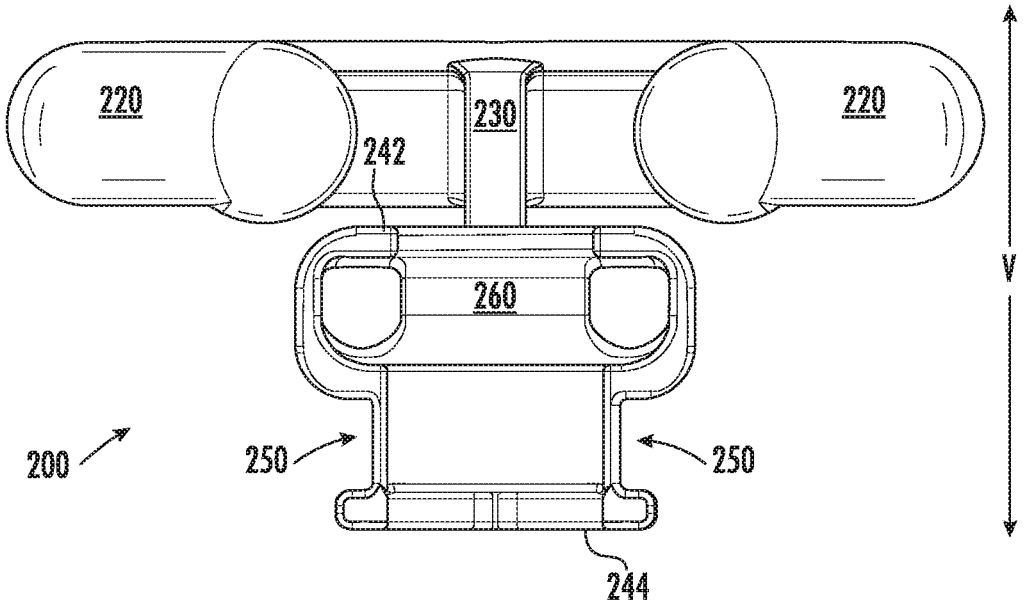
FIG. 5 provides a front view of a corona protection device according to example embodiments of the present disclosure.
Figure 6:
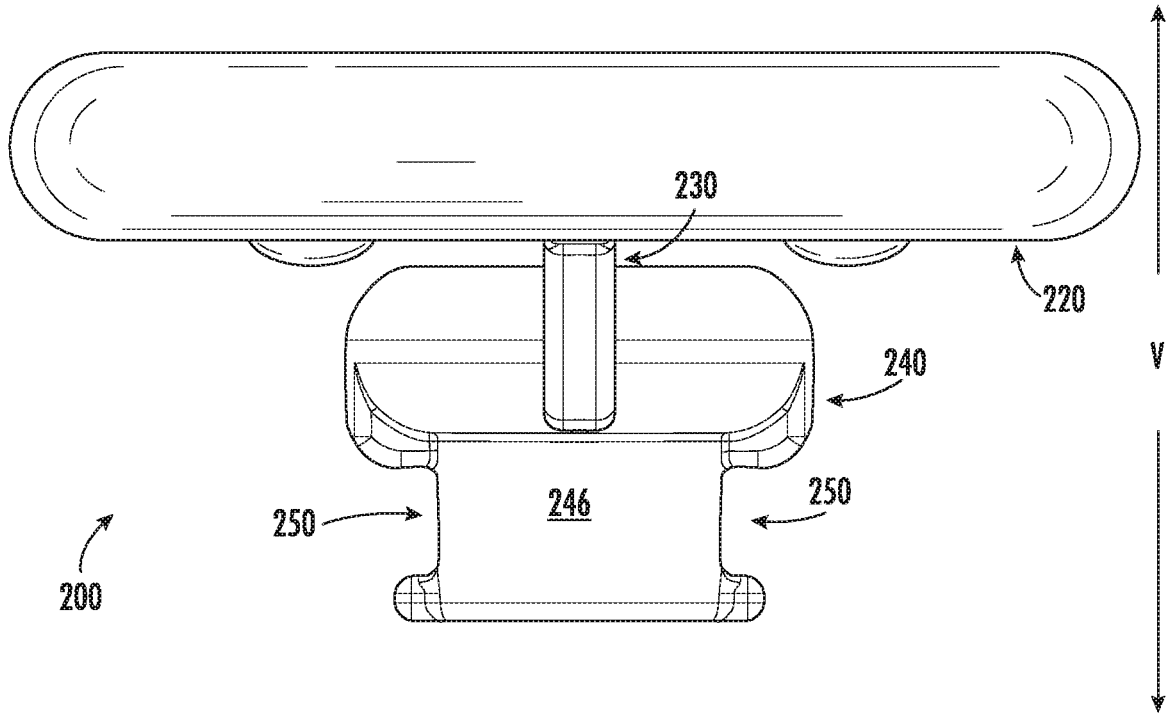
FIG. 6 provides a back view of a corona protection device according to example embodiments of the present disclosure.
Figure 7:
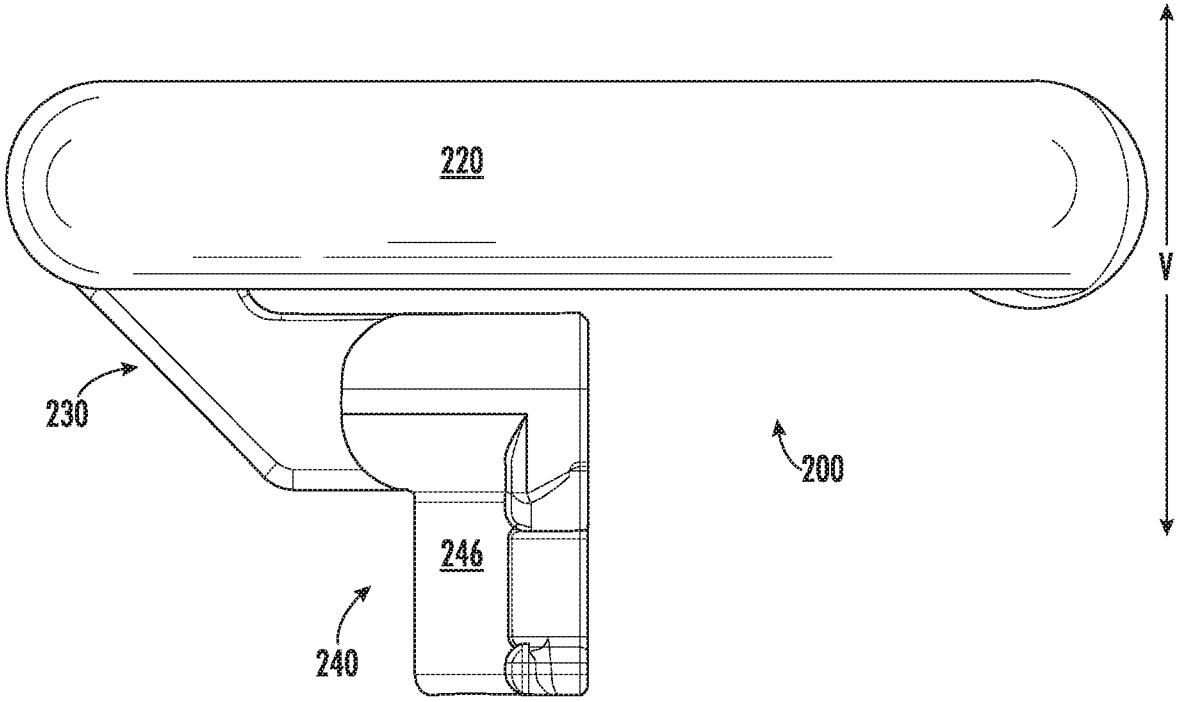
FIG. 7 provides a side view of a corona protection device according to example embodiments of the present disclosure.

As shown, the insulator assembly 100 (FIG. 1) can include a corona protection device 200 to reduce or eliminate corona discharge. Referring now to FIGS. 3 through 7, the corona protection device 200 can include a body 220. The body 220 can define a ring or partial ring. In addition, the corona protection device 200 can include an arm 230 that extends from the body 220. More specifically, the arm 230 can be a single arm. The corona protection device 200 can also include a retention member 240. As shown, the retention member 240 can extend from an end of the arm 230. More specifically, the retention member 240 can extend from an end of the arm 230 that is distal relative to the body 210. In this way, the retention member 240 can be spaced apart from the body 220. For instance, the retention member 240 can, as shown in FIG. 5, be spaced apart from the body 220 along the vertical direction V. In some implementations, the body 220, the arm 230, and the retention member 240 can be integrally formed. In this way, the corona protection device 200 can be a unitary component. It should be appreciated that the corona protection device 200 can be comprised of any suitable material. For instance, the corona protection device 200 can be formed from a metal alloy, such as aluminum.

As shown, the retention member 240 can include a top portion 242 and a bottom portion 244. As shown, the top portion 242 of the retention member 240 and the bottom portion 244 of the retention member 240 can be spaced apart from one another along the vertical direction V. In addition, an exterior surface 246 of the retention member 240 can define one or more notches 250. In some implementations, the exterior surface 246 can define a pair of notches 250 spaced apart from one another along a circumferential direction C.

The retention member 240 can define a cavity 260. As shown, the cavity 260 can extend along the vertical direction V between the one or more notches 250 and the top portion 242 of the retention member 240. As will be discussed below in more detail, the cavity 260 can engage a portion of the insulator assembly 100.

In some implementations, the shape of the retention member 240 can correspond to the shape of a portion of one of the end fittings 132. More specifically, the portion of the end fitting 132 can include the CSR 134. As such, the shape of the retention member 240 can provide a visual indicator to couple the retention member 240 to the portion of the end fitting 132 that includes the CSR 134. In this way, the shape of the retention member 240 can ensure the orientation of the corona protection device 200 is proper (e.g., not upside down).

Figure 8:
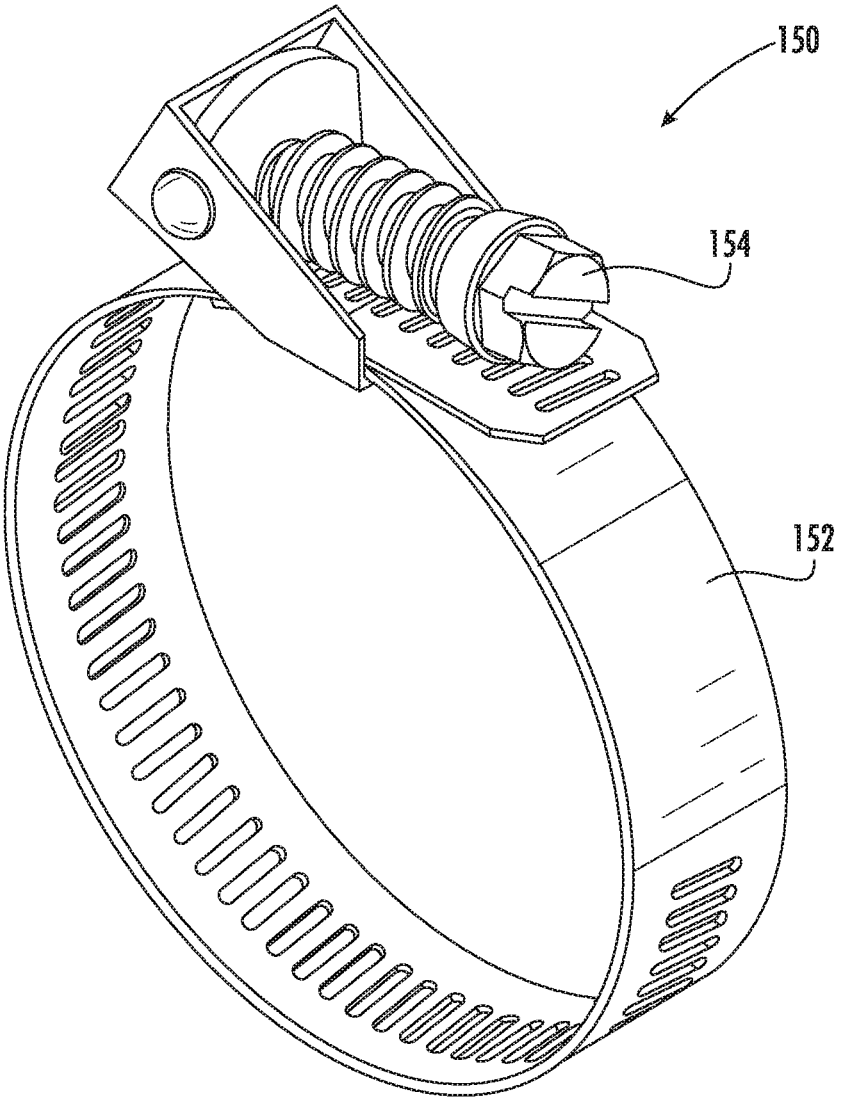
FIG. 8 provides a fastener assembly according to example embodiments of the present disclosure.
Figure 9:
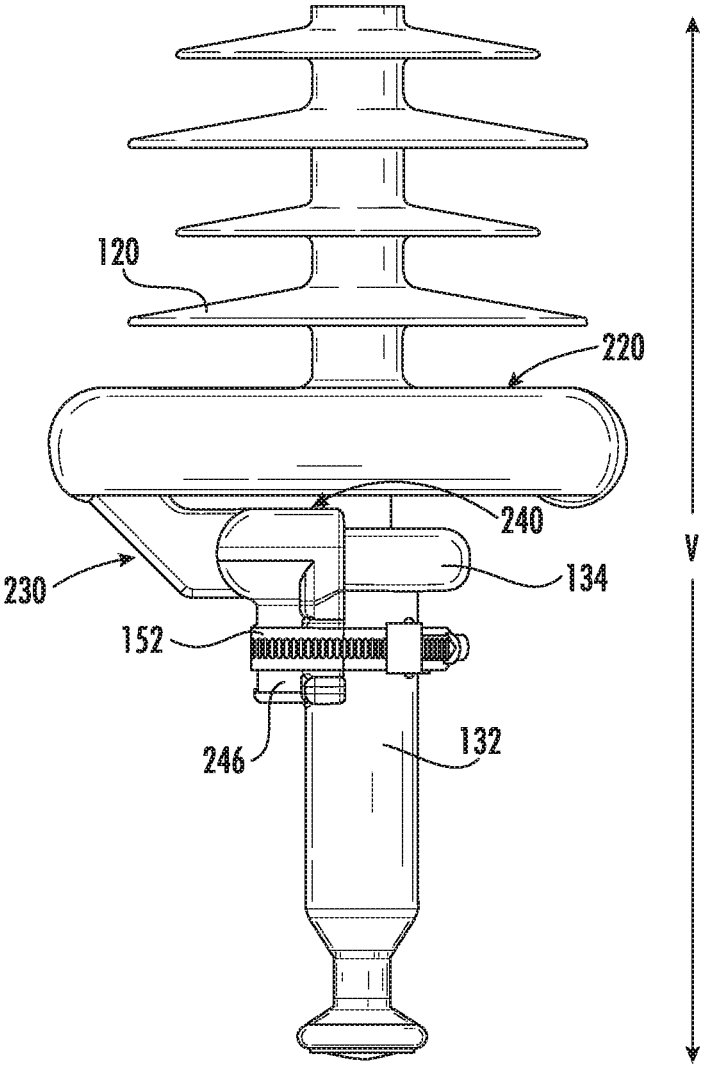
FIG. 9 provides a side view of an end fitting secured to a corona protection device according to example embodiments of the present disclosure.

Referring now to FIGS. 8 and 9 in combination, a fastener assembly 150 can be used to secure the corona protection device 200 to a portion of the insulator assembly 100. In some implementations, the portion of the insulator assembly 100 can include a portion of one of the end fittings 132. For instance, the portion of one of the end fittings 132 can include the CSR 134.

As shown, the fastener assembly 150 can be a band clamp that includes a band 152 and a mechanical fastener 154 (e.g., a screw). It should be appreciated that the band 152 can be any suitable length. For instance, the band 152 can be long enough to wrap around the retention member 240 and one of the end fittings 132 of the insulator assembly 100. Alternatively or additionally, the mechanical fastener 154 can be rotatable in a first direction (e.g., clockwise) or a second direction (e.g., counterclockwise) to tighten or loosen the band 152.

In some implementations, the mechanical fastener 154 can be rotated in the first direction to tighten the band 152. In contrast, the mechanical fastener 154 can be rotated in the second direction to loosen the band 152. As such, the mechanical fastener 154 can be rotated in the first direction to secure the corona protection device 200 to the portion of the insulator assembly 100. In contrast, the mechanical fastener 154 can be rotated in the second direction to remove the corona protection device 200 from the insulator assembly 100.

When the corona protection device 200 is secured to the portion of the insulator assembly 100 via the fastener assembly 150, the corona protection device 200 will remain in place absent application of an external force. In addition, the body 220 can be positioned between the retention member 240 and one of the weathersheds 120 along the vertical direction V. Still further, the cavity 260 can engage a portion of one of the end fittings 132. More specifically, the portion of one of the end fittings 132 can include a portion of the CSR 134. As shown, the one or more notches 250 are configured to receive the band 152 of the fastener assembly 150 when the corona protection device 200 is secured to the portion of the insulator assembly 100. In this way, the fastener assembly 150 can be used to retain the portion of the CSR 134 within the cavity 260 defined by the retention member 240.

Figure 10:
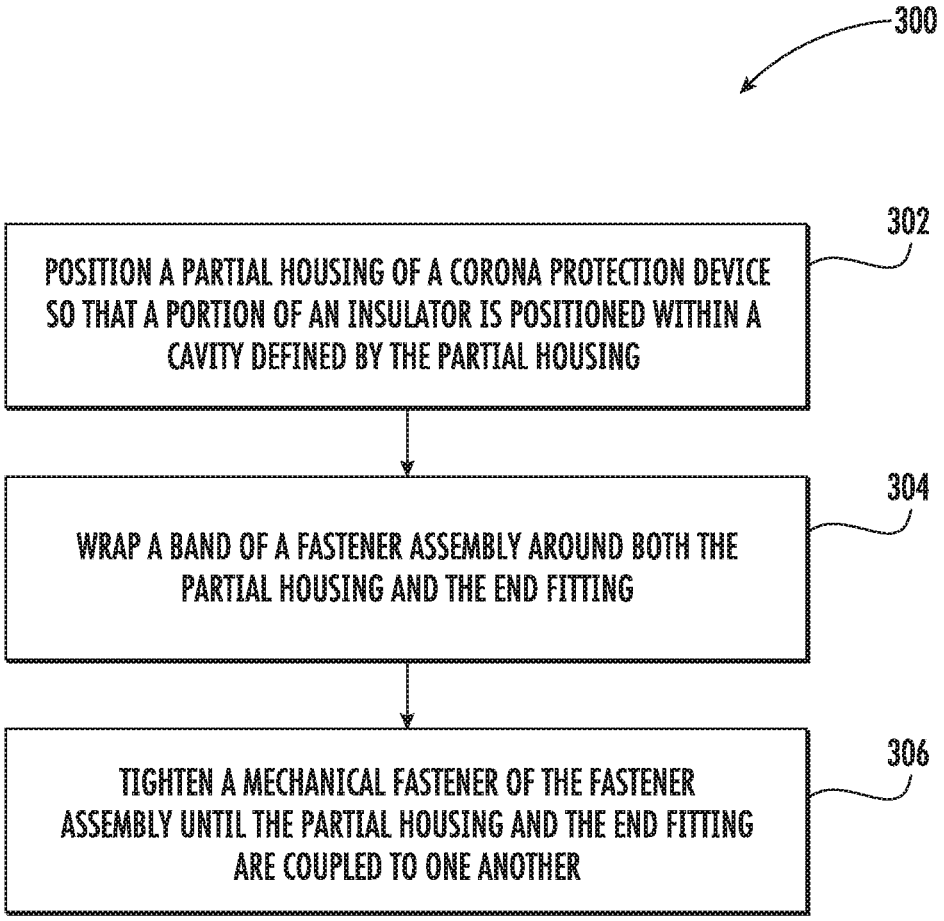
FIG. 10 provides a flow diagram of a method for attaching a corona protection device to an insulator assembly according to example embodiments of the present disclosure.

Referring now to FIG. 10, a flow diagram of one example method 300 for securing a corona protection device to an end fitting of the insulator assembly is provided according to example embodiments of the present disclosure. In general, the method 300 will be discussed with reference to the insulator assembly 100 and corona protection device 200 described above with reference to FIGS. 1 through 9. However, it should be appreciated by those of ordinary skill in the art that the disclosed method 300 can generally be implemented with an insulator assembly having any other suitable configuration. In addition, although FIG. 10 depicts steps performed in a particular order for purposes of illustration and discussion, the method discussed herein can be omitted, rearranged, combined, and/or adapted in various ways without deviating from the scope of the present disclosure.

At (302), the method 300 can include positioning a retention member of the corona protection device so that a portion of the end fitting is positioned within the cavity defined by the retention member. In some implementations, the portion of the end fitting can include a corona suppression ring. More specifically, the portion of the end fitting that is positioned within the cavity can include a portion of the corona suppression ring.

At (304), the method 300 can include installing a fastener assembly around the retention member and the end fitting. More specifically, the fastener assembly can include a band clamp, and installing the fastener assembly can include wrapping the band clamp around both the retention member and the end fitting.

At (306), the method 300 can include tightening the fastener assembly to secure the corona protection device to the end fitting. More specifically, tightening the fastener assembly can include rotating a mechanical fastener of the fastener assembly in a first direction (e.g., clockwise) to secure the corona protection device to the end fitting.

Figure 11:
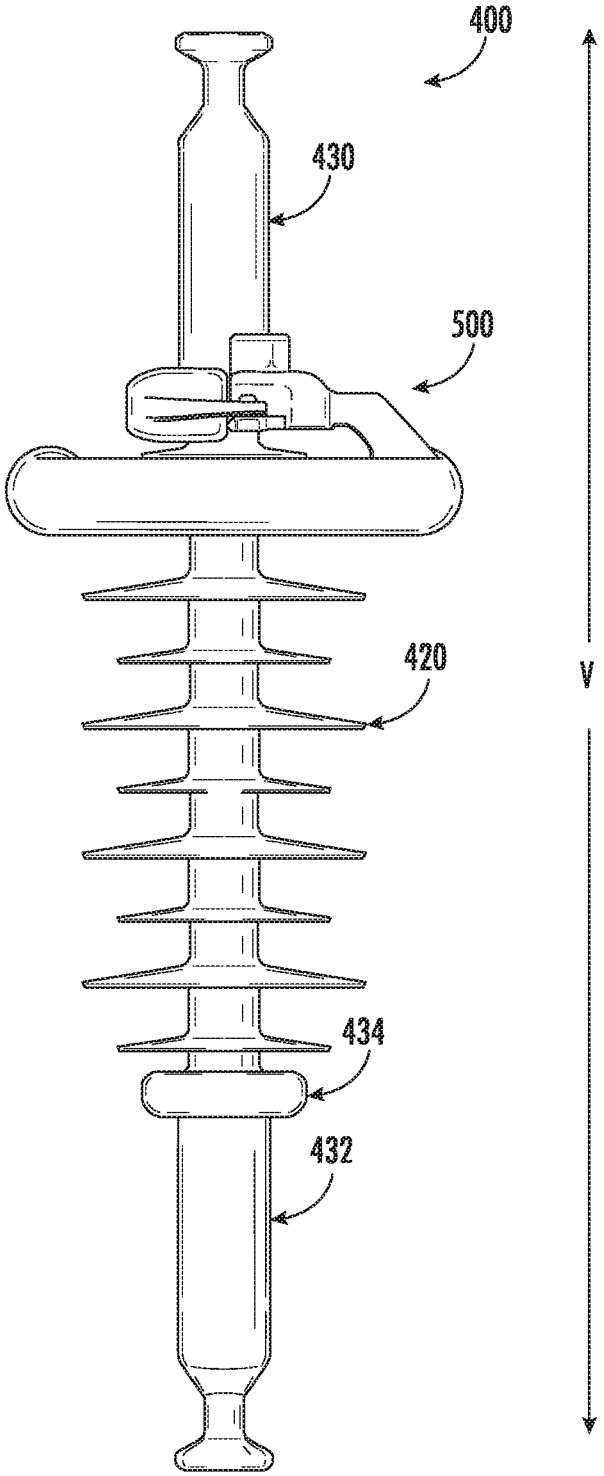
FIG. 11 provides a side view of another insulator assembly according to example embodiments of the present disclosure.
Figure 12:
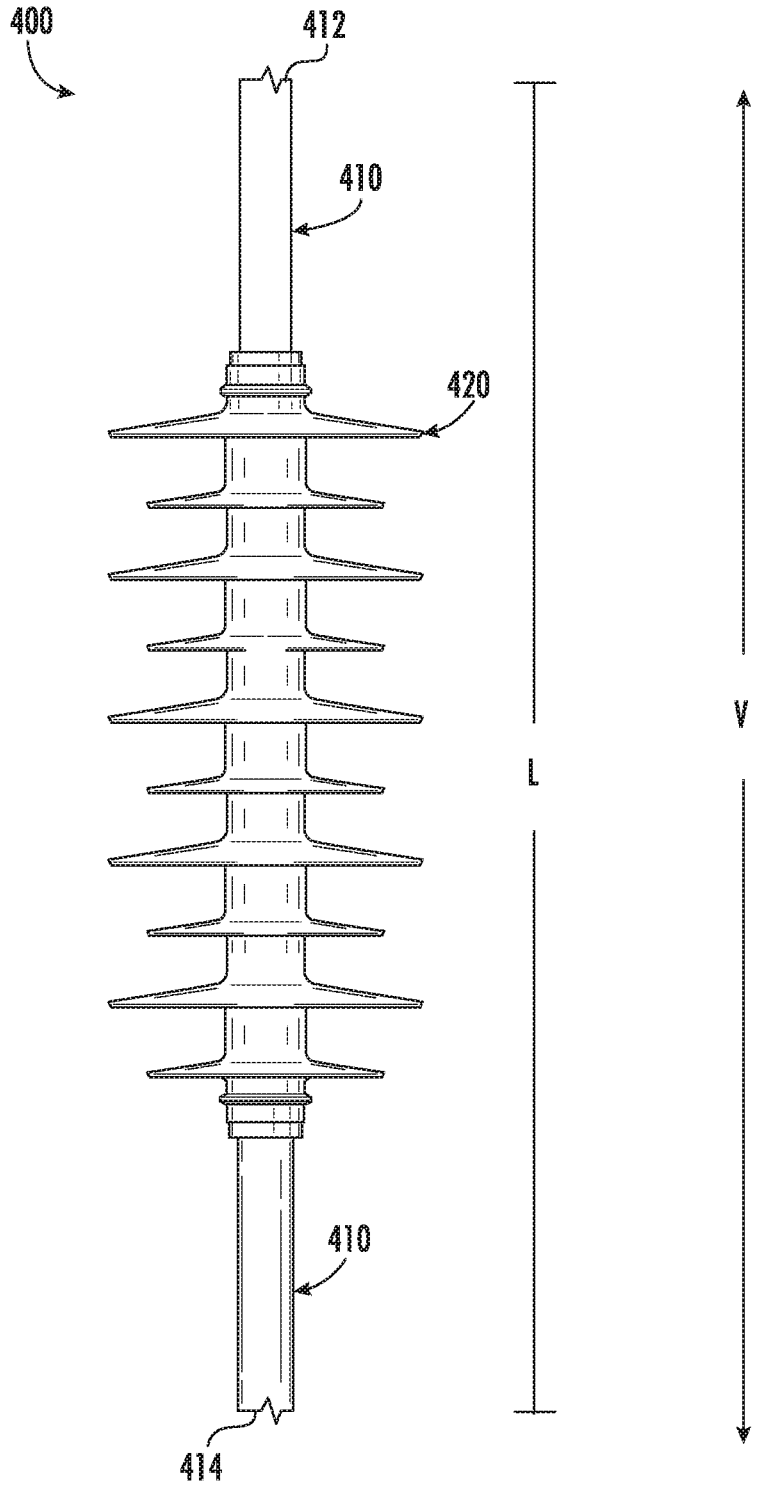
FIG. 12 provides another side view of the insulator assembly of FIG. 11 according to example embodiments of the present disclosure.
Figure 13:
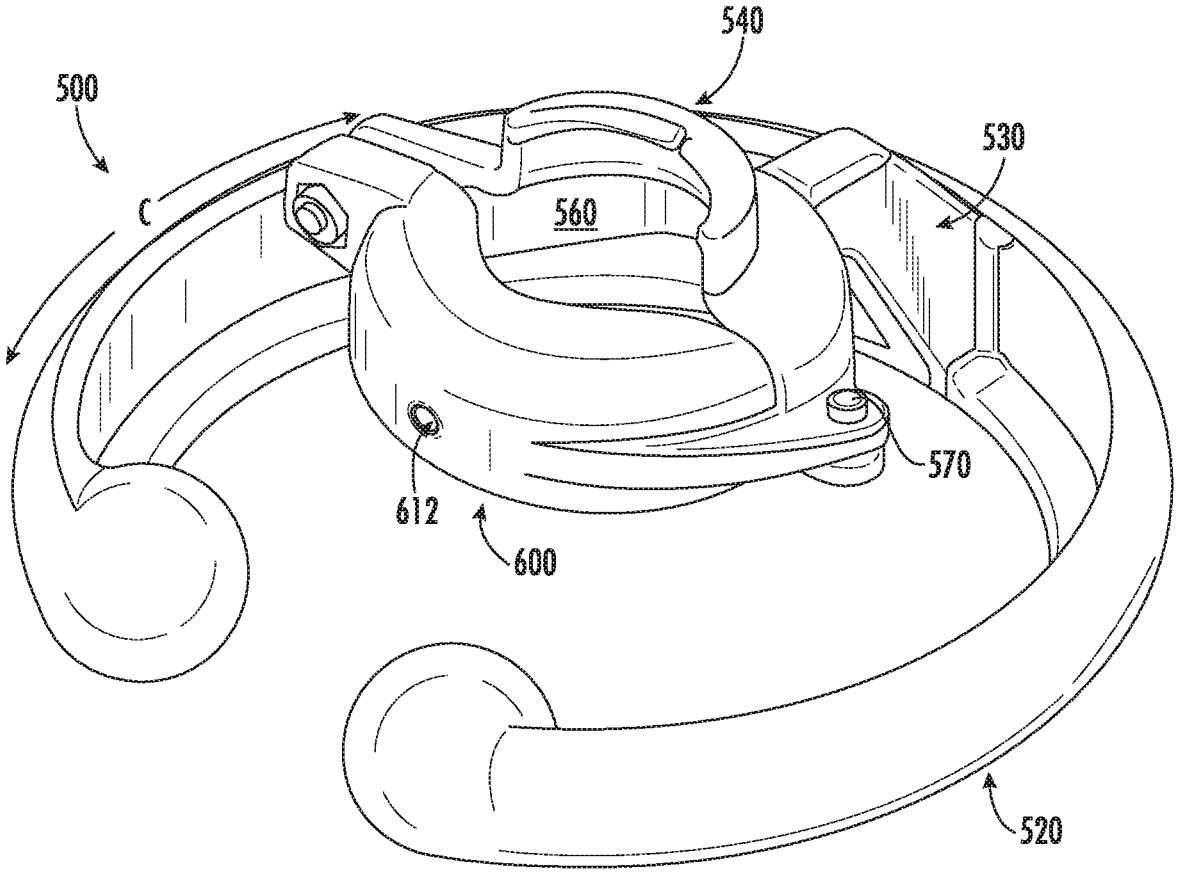
FIG. 13 provides a perspective view of a corona protection device according to example embodiments of the present disclosure.

Referring now to FIGS. 11 and 12, another insulator assembly 400 is provided according to example embodiments of the present disclosure. As shown, the insulator assembly 100 can include a core 410 extending between a first end 412 and a second end 414 along a vertical direction V. In some implementations, the core 410 can include resin-bonded glass fibers. It should be appreciated, however, that the core 410 can be comprised of any suitable material.

The insulator assembly 400 can include a plurality of weathersheds 420 surrounding the core 410 and spaced apart from one another along a length L of the core 410. It should be appreciated that the plurality of weathersheds 420 can be comprised of any suitable material. For instance, the plurality of weathersheds 420 can be comprised of a composite material, such as silicone rubber.

The insulator assembly 400 can include a pair of end fittings 430, 432 secured to the core 410. In some implementations, each end fitting 430, 432 can fit over one of the ends 412, 414 of the core 410. In this way, the end fittings 430, 432 can be used to cap respective ends 412, 414 of the core 410. It should be appreciated that the end fittings 430, 432 can include any suitable type of end fitting. For instance, one of the end fittings 432 can be a ball-end fitting.

In some implementations, each end fitting of the pair of end fittings 130, 132 can include a corona suppression ring (CSR) 434. For example, the CSR 434 can be integral with the end fittings 430, 432. It should be appreciated that both the CSR 434 and the pair of end fittings 430, 432 can be comprised of any suitable material. For example, both the CSR 434 and the pair of end fittings 430, 432 can be comprised of aluminum. As will be discussed below in more detail, the insulator assembly 400 can include a corona protection device 500 to reduce or eliminate corona discharge.

Referring now to FIGS. 13-18, the corona protection device 500 defines a coordinate system comprising a radial direction R, a circumferential direction C, and a vertical direction V. The corona protection device 500 can include a body 520. In some embodiments, the body 520 can be a ring or a partial ring. It should be appreciated, however, that the body 520 of the corona protection device 500 can have any suitable shape. As shown, the corona protection device 500 can include an arm 530 extending from the body 520. For instance, the arm 530 can be a single arm.

Figure 14:
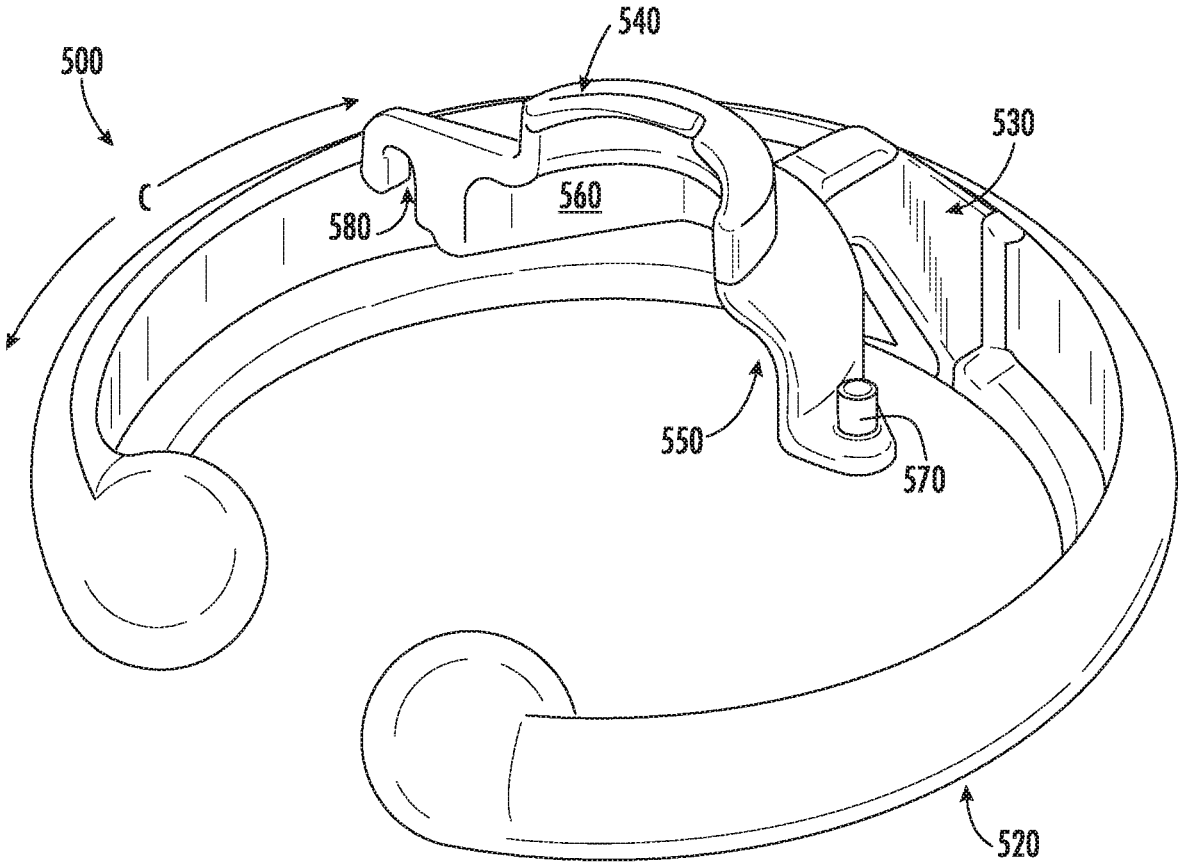
FIG. 14 provides a perspective view of a retention member of the corona protection device of FIG. 13 according to example embodiments of the present disclosure.
Figure 15:
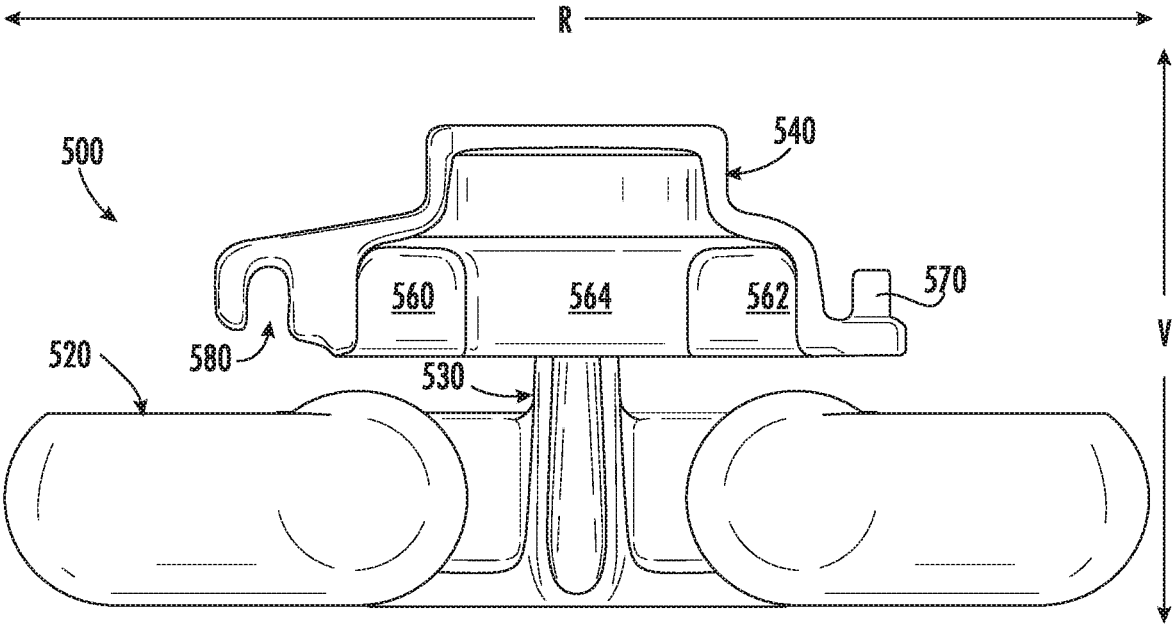
FIG. 15 provides a front view of the retention member of FIG. 14 according to example embodiments of the present disclosure.
Figure 16:
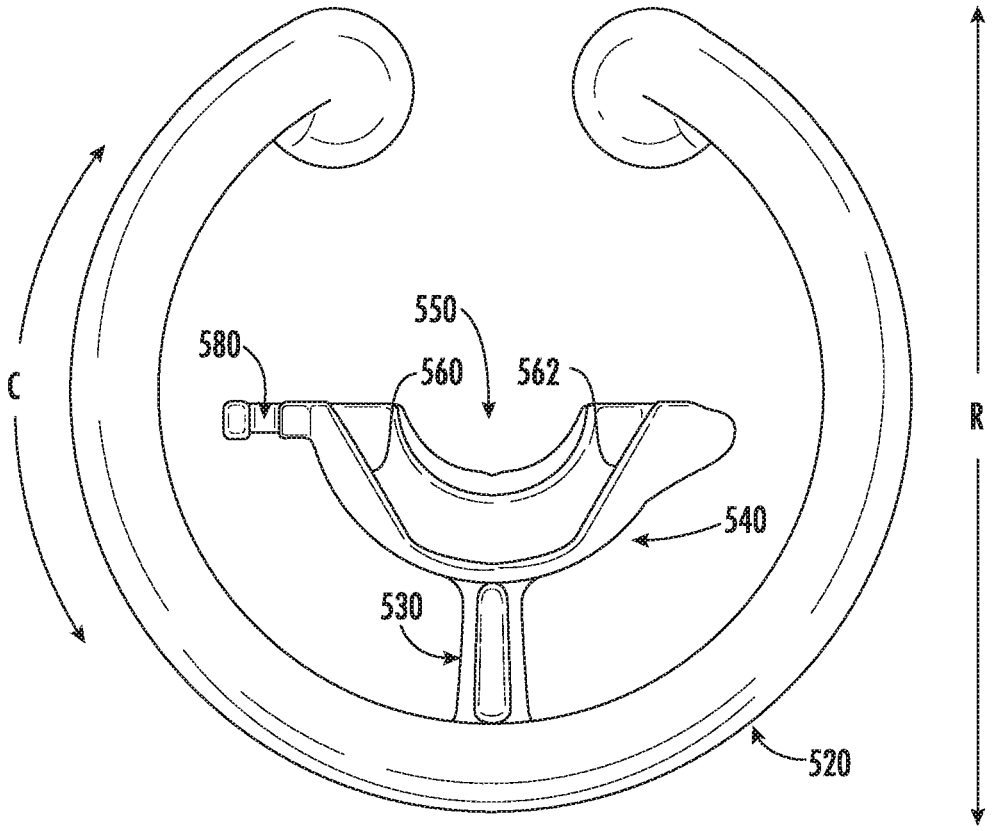
FIG. 16 provides a bottom view of the retention member of FIG. 14 according to example embodiments of the present disclosure.

In some implementations, the corona protection device 500 can include a retention member 540. As shown, the retention member 540 can extend from an end of the arm 530. For instance, as shown in FIG. 14, the retention member 540 can extend from an end of the arm 530 that is distal relative to the body 520 of the corona protection device 500. In this way, the retention member 540 can, as shown in FIG. 15, be spaced apart from the body 520 along the vertical direction V. In some implementations, the body 520, the arm 530, and the retention member 540 can be integrally formed as a unitary component of the corona protection device 500. Additionally, it should be appreciated that the unitary component can be formed from any suitable material. For instance, the unitary component can be formed from a metal alloy, such as aluminum.

In some implementations, a shape of the retention member 540 can correspond to a shape of a portion of one of the end fittings 430, 432 (FIG. 11). For instance, the shape of the retention member 540 can correspond to the portion of the end fittings 430, 432 that includes the CSR 434. In this manner, the shape of the retention member 540 can provide a visual indicator to secure the retention member 540 to the portion of end fitting 430 that includes the CSR 434. More specifically, the shape of the retention member 540 can ensure the orientation of the corona protection device 500 is proper (e.g., not upside down).

As shown, the retention member 540 defines a cavity 550 configured to engage the portion of the end fitting 430 that includes the CSR 434. More specifically, the cavity 550 can be defined, at least in part, by opposing surfaces 560, 562 of the retention member 540 and a rear surface 564 of the retention member 540 that extends between the opposing surfaces 560, 562 of the retention member 540 along the circumferential direction C. In some implementations, the opposing surfaces 560, 562 can be tapered surfaces extending along the radial direction R between a front portion of the retention member 540 and the rear surface 564 of the retention member 540. In this manner, the cavity 550 defined, at least in part, by the opposing surfaces 560, 562 can narrow along the radial direction R from the front portion of the retention member 540 to the rear surface 564 of the retention member 540. In some implementations, a portion of the CSR 434 disposed within the cavity 550 can contact (e.g., touch) the tapered surface 560, 562 of the retention member 540. For instance, the portion of the CSR 434 can contact the tapered surfaces 560, 562 of the retention member 540 such that the portion of the CSR 434 is spaced apart from the rear surface 564 of the retention member 540 along the radial direction R. In this manner, a gap can be defined along the radial direction R between the portion of the CSR 434 and the rear surface 564 of the retention member 540.

In some implementations, the retention member 540 can include a post or projection 570 that extends along the vertical direction V. Alternatively or additionally, the retention member 540 can define a notch 580 that is spaced apart from the post 570 along the radial direction R. In some implementations, one or more surfaces of the retention member 540 that define the notch 580 can be tapered. In this manner, the notch 580 can taper along the radial direction R. As will be discussed below in more detail, the corona protection device 500 can include a clamping member configured to secure the retention member 540 to the portion of the end fitting 430 that includes the CSR 434.

Figure 17:
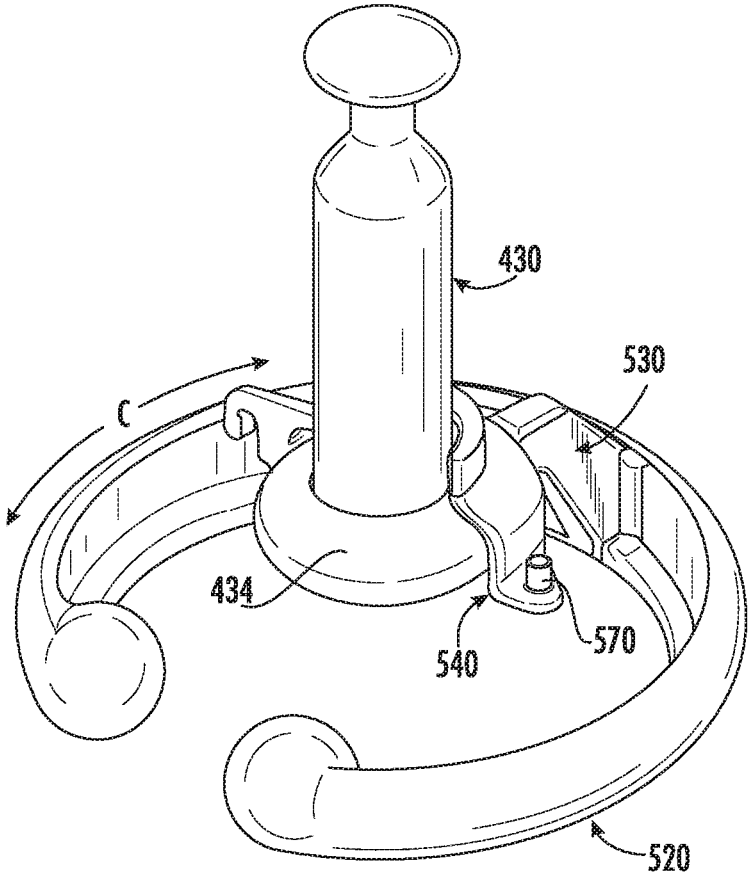
FIG. 17 provides perspective view of a corona protection device engaging a portion of the end fitting of FIG. 11 according to example embodiments of the present disclosure.
Figure 18:
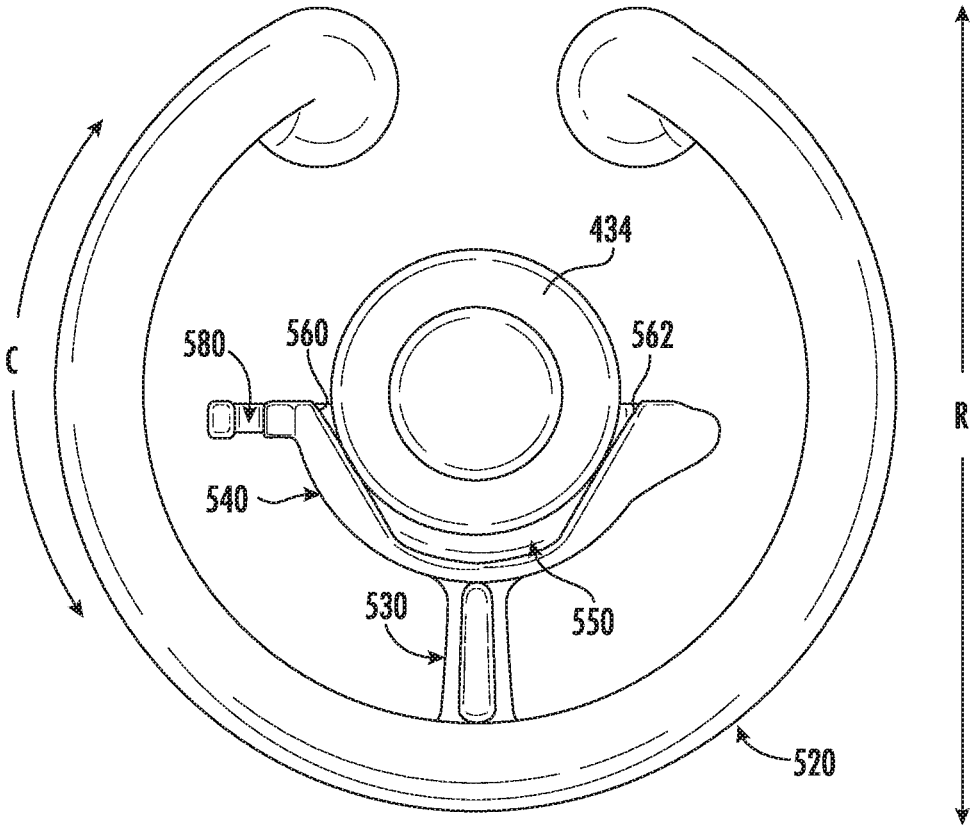
FIG. 18 provides a bottom view of FIG. 16 according to example embodiments of the present disclosure.
Figure 19:
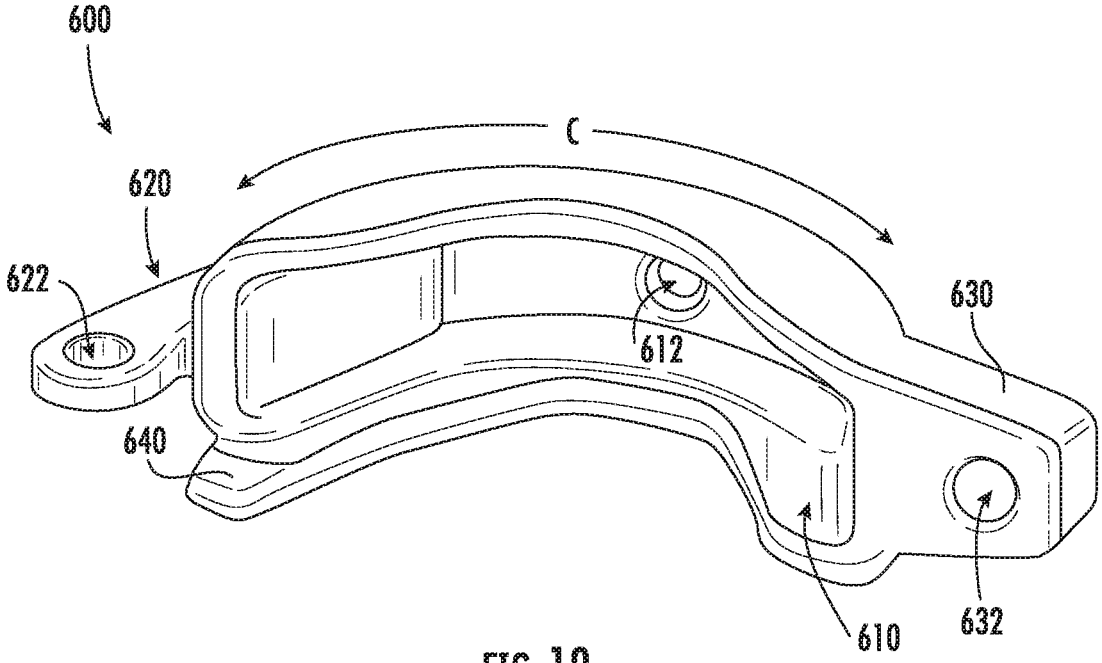
FIG. 19 provides a perspective view of a clamping member of the corona protection device of FIG. 13 according to example embodiments of the present disclosure.
Figure 20:
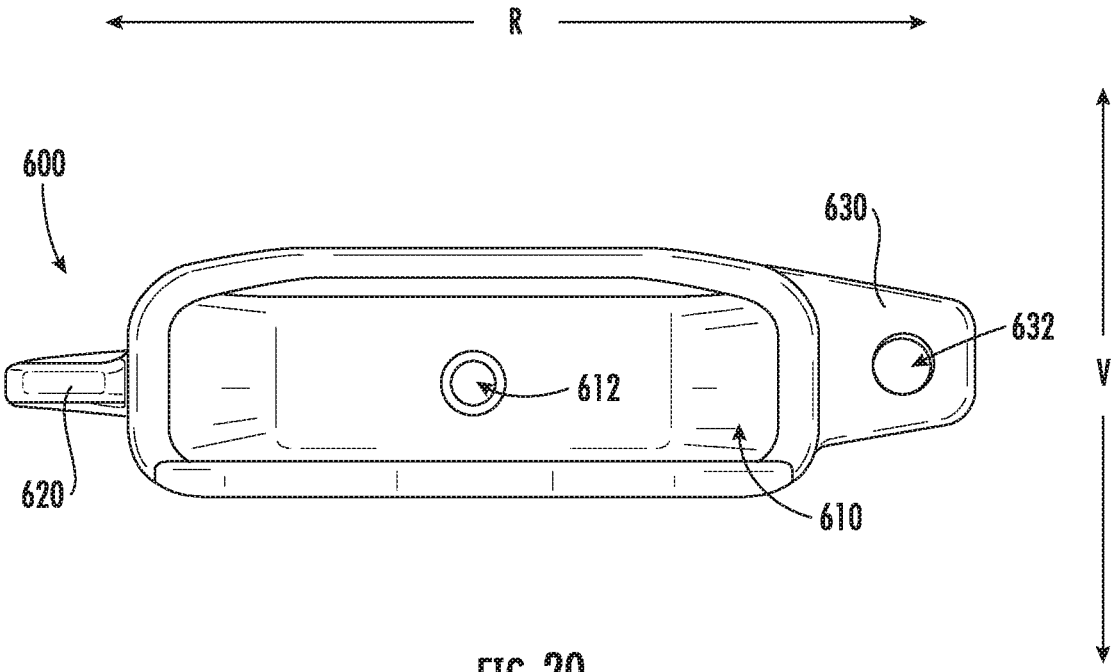
FIG. 20 provides a front view of the clamping member of FIG. 19 according to example embodiments of the present disclosure.
Figure 21:
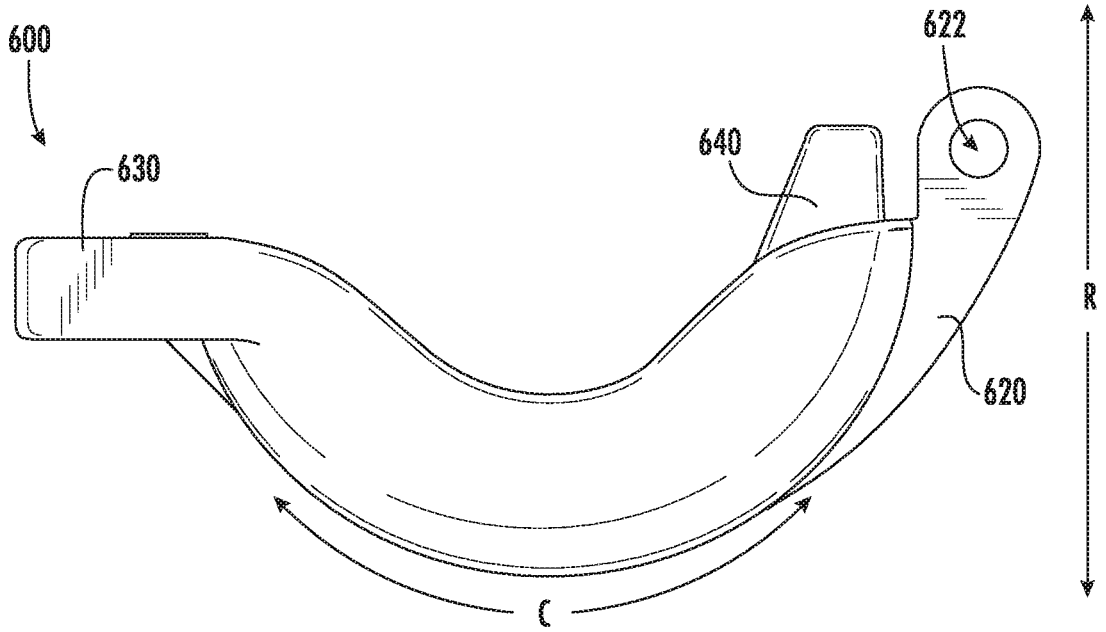
FIG. 21 provides a top view of the clamping member of FIG. 19 according to example embodiments of the present disclosure.
Figure 22:
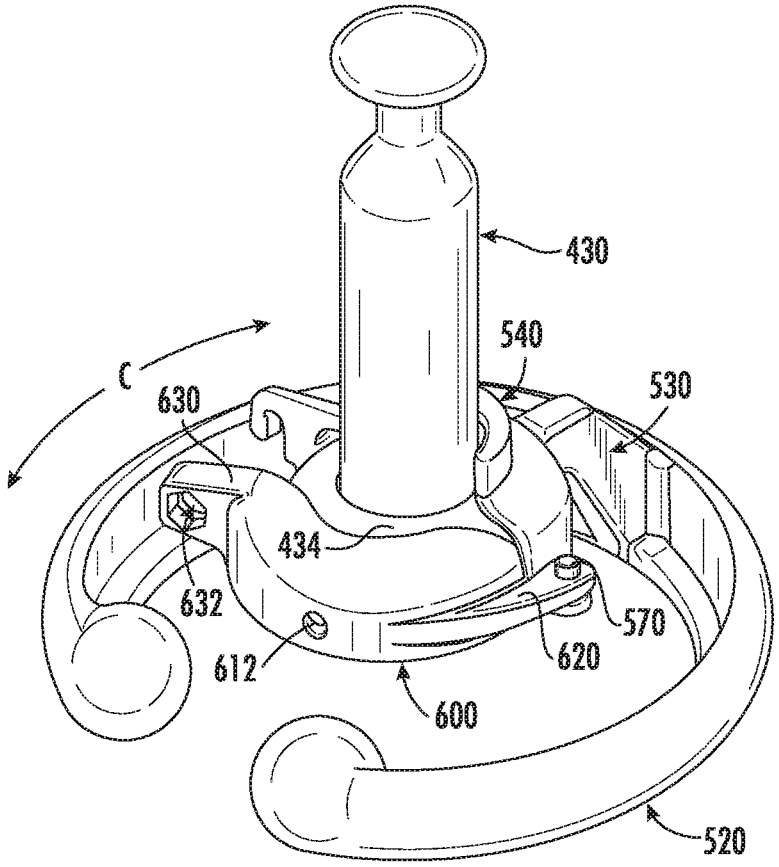
FIG. 22 depicts the clamping member of FIG. 19 mounted to a retention member of a corona protection device according to example embodiments of the present disclosure.

Referring now to FIGS. 19-21, a clamping member 600 of the corona protection device 500 (FIG. 13) is provided according to example embodiments of the present disclosure. As shown, the shape of the clamping member 600 can correspond to the portion of end fitting 430 (FIG. 17) that includes the CSR 434 (FIG. 17). In this manner, a cavity 610 defined by the clamping member 600 can be adapted to engage a portion of the CSR 434. In some implementations, the clamping member 600 can define a drain port 612. In this manner, fluid (e.g., water) within the cavity 610 can flow out of the cavity 610 via the drain port 612. Alternatively or additionally, the clamping member 600 can include a first arm 620 and a second arm 630. As shown, the first arm 620 can be spaced apart from the second arm 630 along the circumferential direction C.

In some implementations, the first arm 620 of the clamping member 600 can define an aperture 622 oriented in a first plane that is substantially parallel to the circumferential direction C. Additionally, the second arm 630 of the clamping member 600 can define an aperture 632 oriented in a second plane that is substantially perpendicular to the circumferential direction C. As will be discussed below in more detail, the clamping member 600 can be mounted to the retention member 540 (FIG. 13) of the corona protection device 500.

Figure 23:
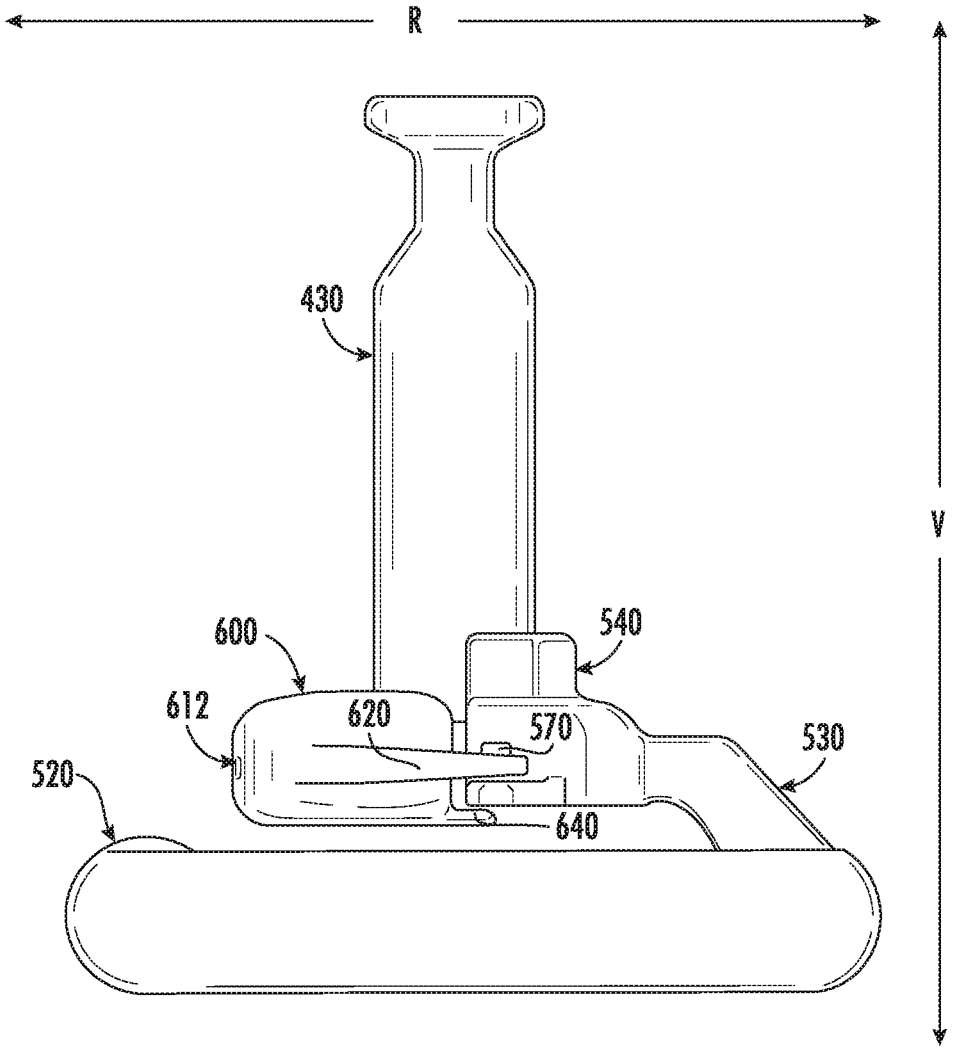
FIG. 23 provides a side view of FIG. 22 according to example embodiments of the present disclosure.
Figure 24:
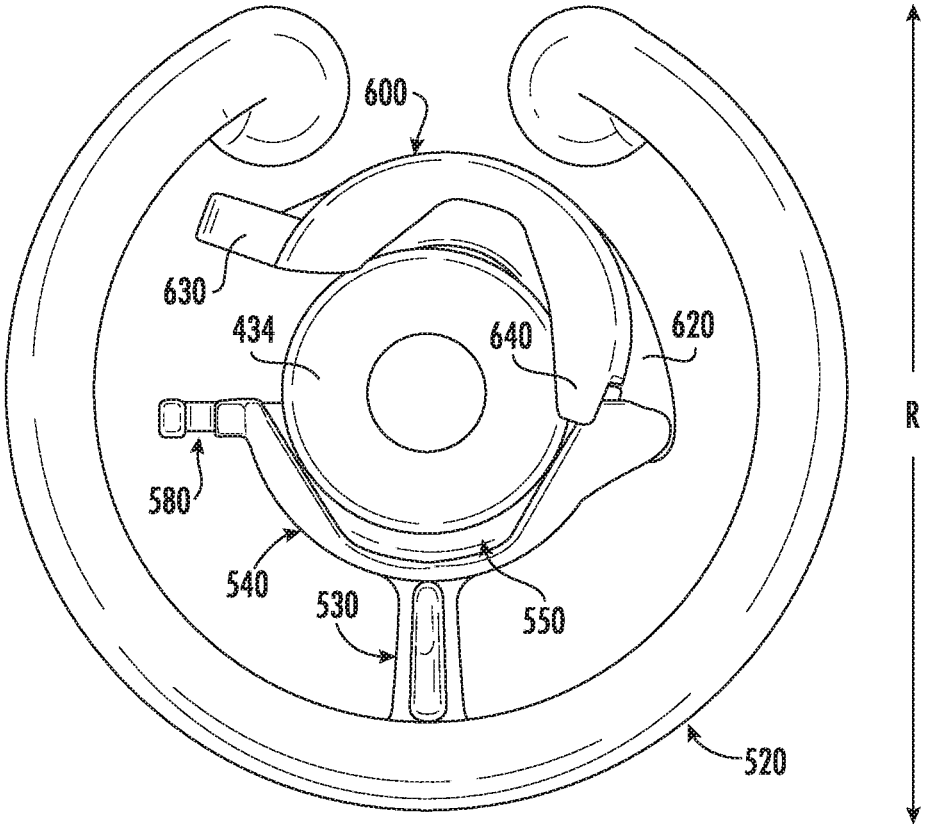
FIG. 24 provides a bottom view of FIG. 22 according to example embodiments of the present disclosure.

Referring now to FIGS. 22-26, the first arm 620 of the clamping member 600 can be mounted to the post 570 of the retention member 540 such that the clamping member 600 can rotate relative to the retention member 540. More specifically, the post 570 of the retention member 540 can extend through the aperture 622 defined by the first arm 620 of the clamping member 600. Furthermore, when the first arm 620 of the clamping member 620 is mounted to the post 570 of the retention member 540, a portion of the retention member 540 can, as shown in FIG. 23, be disposed between the first arm 620 of the clamping member 600 and a lip 640 of the clamping member 600 along the vertical direction V. In this manner, movement of the clamping member 600 along the vertical direction V can be limited.

In some implementations, the clamping member 600 can rotate relative to retention member 540 to align the aperture 632 defined by the second arm 630 of the clamping member 600 with the notch 580 defined by the retention member 540. For instance, the clamping member 600 can rotate along the circumferential direction C to align the aperture 632 defined by the second arm 630 of the clamping member 600 with the notch 580 defined by the retention member 540. As will be discussed below in more detail, the clamping member 600 can be secured to the retention member 540 via a fastener assembly configured to apply a clamping force. In this manner, the applied clamping force can secure the retention member 540 to the portion of the end fitting 430 that includes the CSR 434.

Figure 25:
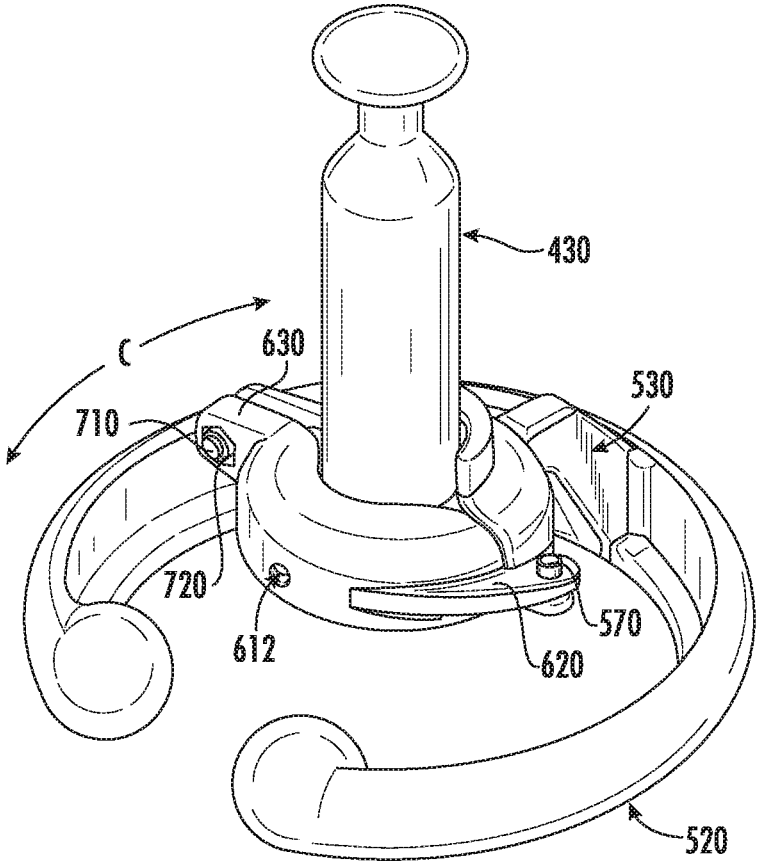
FIG. 25 depicts the clamping member of FIG. 19 secured to a retention member of a corona protection device according to example embodiments of the present disclosure.
Figure 26:
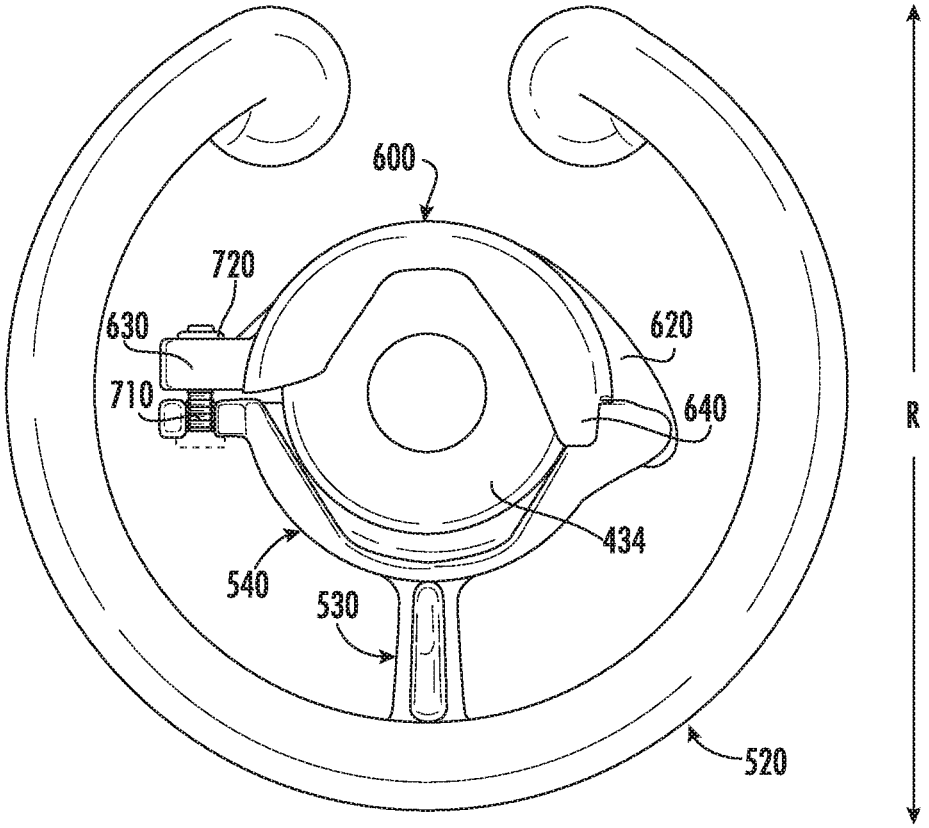
FIG. 26 depicts a bottom view of FIG. 25 according to example embodiments of the present disclosure FIG. 27 provides a perspective view of another corona protection device according to example embodiments of the present disclosure.

Referring now to FIGS. 25 and 26, the fastener assembly can include a bolt 710 and a nut 720. In some implementations, both the bolt 710 and the nut 720 can be threaded. In this manner, the bolt 710 can be secured (e.g., fastened) to the nut 720. As shown, the bolt 710 can extend along the radial direction R through the notch 580 defined by the retention member 540. Additionally, the bolt 710 can extend along the radial direction R through the aperture 632 defined by the second arm 630 of the clamping member 600. As shown, a shape of the nut 720 can correspond to a shape of the aperture 632 defined by the second arm 630 of the clamping member 600. In some implementations, the nut 720 cannot rotate when disposed within the aperture 632. As such, the bolt 710 can rotate relative to the nut 720 such that a threaded portion (not shown) of the bolt 710 meshes with a threaded portion (not shown) of the nut 720 to secure (e.g., fasten) the bolt 710 to the nut 720. When the bolt 710 is secured to the nut 720, the clamping member 600 is secured to the retention member 540. Additionally, the retention member 540 is secured to the portion of the end fitting 430 that includes the CSR 434.

Figure 27:
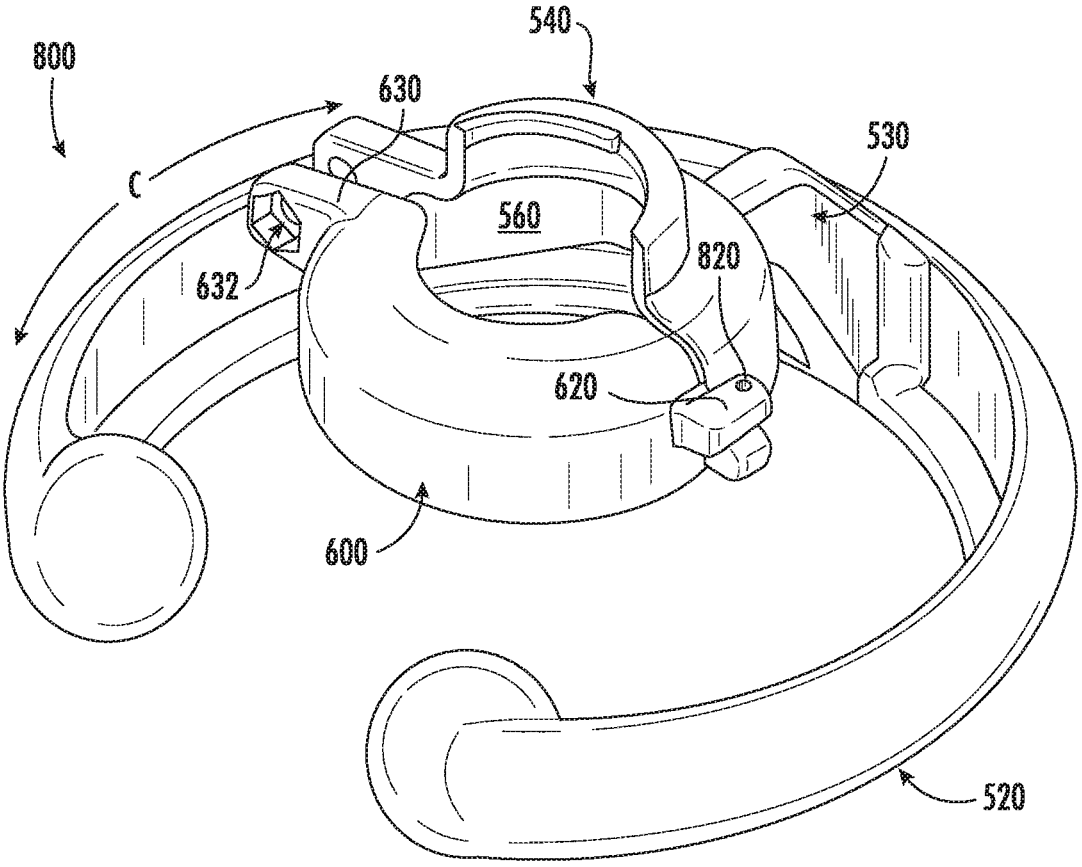
Figure 28:
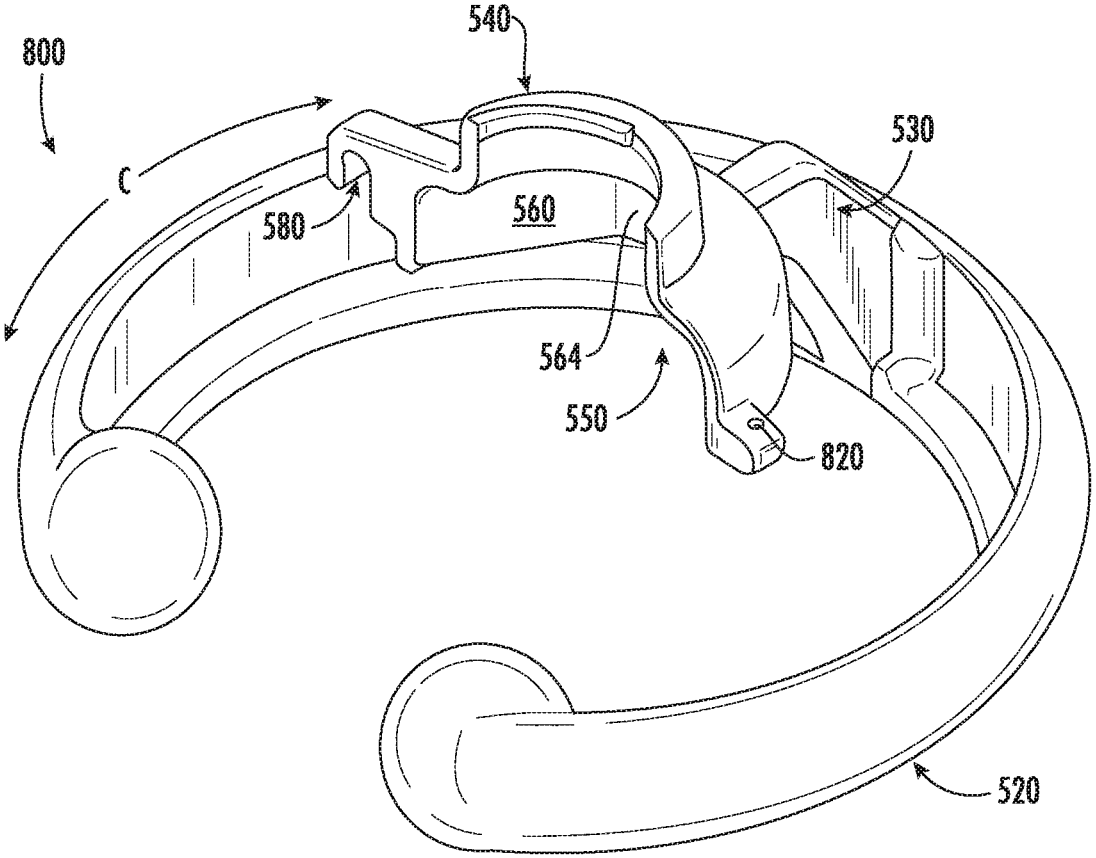
FIG. 28 provides another perspective view of the corona protection device of FIG. 27 according to example embodiments of the present disclosure.
Figure 29:
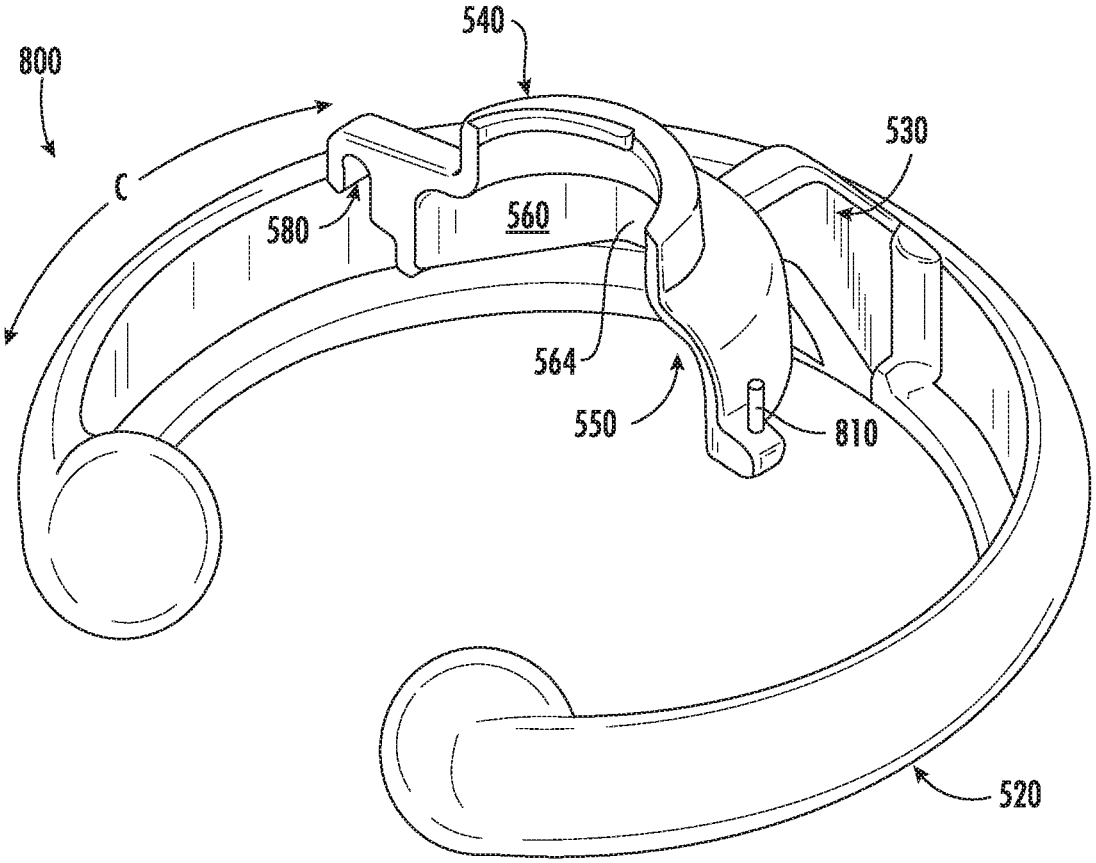
FIG. 29 provides yet another perspective view of the corona protection device of FIG. 27 according to example embodiments of the present disclosure.

Referring now to FIGS. 27-29, another embodiment of a corona protection device 800 is provided according to example embodiments of the present disclosure. The corona protection device 800 of FIGS. 27-29 is similar to the corona protection device 500 discussed above with reference to FIG. 13. For instance, the corona protection device 800 of FIGS. 27-29 includes a body 520, a retention member 540, and a clamping member 600. However, in contrast to the corona protection device 500 of FIG. 13, the corona protection device 800 of FIGS. 27-29 does not include a post or projection 570 (FIG. 13) that is integrally formed with the retention member 540. Instead, the corona protection device 800 of FIGS. 27-29 includes a mounting pin 810 that is separate from the retention member 540.

As may be seen in FIG. 28, the retention member 540 of the corona protection device 800 defines an aperture 820. In some implementations, the aperture 820 can be configured to accommodate an end of the mounting pin 810. In this manner, the mounting pin 810 can, as shown in FIG. 29, be removably mounted to the retention member 540. Once the mounting pin 810 is mounted to the retention member 540, the clamping member 600 can be mounted to the retention member 540. For instance, the first arm 620 of the clamping member 600 can be mounted to the pin 810. In this manner, the clamping member 600 can rotate relative to the retention member 540 to align the aperture 632 defined by the second arm 630 of the clamping member 600 with the notch 580 defined by the retention member 540 such that the clamping member 600 can be secured to the retention member 540 via a fastener assembly, such as the fastener assembly discussed above with reference to FIGS. 25 and 26, to secure the clamping member 600 to the retention member 540. It should be appreciated, however, that any suitable fastener assembly can be used to secure the clamping member 600 to the retention member 540.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A corona protection device for use with an insulator assembly, the corona protection device comprising:

a body;

an arm extending from the body;

a retention member extending from the arm, the retention member defining a cavity adapted to engage a portion of an end fitting of the insulator assembly; and a clamping member removably mounted to the retention member, the clamping member defining a cavity adapted to engage a portion of the end fitting of the assembly, wherein the clamping member includes a first arm defining an aperture in a first plane and a second arm defining an aperture in a second plane that is substantially perpendicular to the first plane.

2. The corona protection device of claim 1, wherein a shape of the retention member corresponds to a shape of the portion of the end fitting.

3. The corona protection device of claim 2, wherein the portion of the end fitting comprises a corona suppression ring.

4. The corona protection device of claim 1, wherein the retention member is spaced apart from the body along a vertical direction.

5. The corona protection device of claim 1, wherein when the clamping member is mounted to the retention member, a post of the retention member extends through the aperture defined by the first arm of the clamping member, and wherein the clamping member is rotatable relative to the retention member.

6. The corona protection device of claim 1, wherein when the clamping member is mounted to the retention member, a portion of the retention member is positioned between the first arm of the clamping member and a lip of the clamping member along a vertical direction to limit movement of the clamping member along the vertical direction.

7. The corona protection device of claim 1, wherein the cavity is defined, at least in part, by tapered surfaces of the retention member and a rear surface of the retention member that extends between the tapered surfaces along a circumferential direction, and wherein when the cavity engages the portion of the end fitting, the portion of the end fitting contacts the tapered surfaces of the retention member such that the portion of the end fitting is spaced apart from the rear surface along a radial direction.

8. The corona protection device of claim 1, wherein the retention member comprises a post, and wherein the retention member further defines a notch spaced apart from the post along a radial direction.

9. The corona protection device of claim 8, wherein the notch is defined, at least in part, by tapered surfaces of the retention member such that the notch is tapered along the radial direction.

10. An insulator assembly, comprising:

a core;

a plurality of weathersheds surrounding the core;

an end fitting secured to the core; and a corona protection device coupled to the end fitting, the corona protection device comprising, a body defining at least a partial ring, a single arm extending from the body, a retention member extending from the arm, the retention member defining a cavity adapted to receive a corona suppression ring of the end fitting, and a clamping member removably mounted to the retention member, the clamping member defining a cavity adapted to engage a portion of the end fitting, wherein the clamping member includes a first arm defining an aperture in a first plane and a second arm defining an aperture in a second plane that is substantially perpendicular to the first plane.

11. The insulator assembly of claim 10, wherein a shape of the retention member corresponds to a shape of the corona suppression ring.

12. The insulator assembly of claim 10, wherein the corona suppression ring is integrally formed with the end fitting.

13. The insulator assembly of claim 10, wherein the retention member is spaced apart from the body along a vertical direction.

14. The insulator assembly of claim 10, wherein the clamping member is rotatable relative to the retention member.

15. The insulator assembly of claim 10, wherein the aperture in the second plane receives a pin extending from the retention member.

16. The insulator assembly of claim 10, wherein when the clamping member is mounted to the retention member, a post of the retention member extends through the aperture defined by the first arm of the clamping member, and wherein the clamping member is rotatable relative to the retention member.

17. The insulator assembly of claim 10, wherein when the clamping member is mounted to the retention member, a portion of the retention member is positioned between the first arm of the clamping member and a lip of the clamping member along a vertical direction to limit movement of the clamping member along the vertical direction.

18. The insulator assembly of claim 10, wherein the clamping member defines a drain port configured to drain the cavity defined by the clamping member.

19. The insulator assembly of claim 10, wherein the single arm is connected to said body on one end thereof and connected to the midpoint of said retention member of another end thereof.

20. The insulator assembly of claim 10, wherein the core extends along a longitudinal axis and the clamping member is rotatable relative to the retention member about an axis extending parallel to the longitudinal axis.

* * * * *